US006948470B2

(12) United States Patent
Tsutsumi et al.

(10) Patent No.: US 6,948,470 B2
(45) Date of Patent: Sep. 27, 2005

(54) FOUR-CYCLE ENGINE

(75) Inventors: Koichi Tsutsumi, Saitama (JP); Hidetoshi Takamatsu, Saitama (JP); Itoko Kobayashi, Saitama (JP); Ryuichi Abe, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/658,263

(22) Filed: Sep. 10, 2003

(65) Prior Publication Data

US 2004/0103871 A1 Jun. 3, 2004

(30) Foreign Application Priority Data

Sep. 12, 2002 (JP) ..... 2002-267178

(51) Int. Cl.[7] ..... F01F 1/24; F02B 61/02; F01L 1/00; B60K 5/04

(52) U.S. Cl. ..... 123/193.5; 123/193.3

(58) Field of Search ..... 123/193.1–193.5, 123/90.27, 90.39–90.47

(56) References Cited

U.S. PATENT DOCUMENTS 3,400,696 A * 9/1968 Thompson ..... 123/90.27
5,148,781 A * 9/1992 Piatti ..... 123/193.5
6,089,196 A * 7/2000 Izuo et al. ..... 123/90.11
6,453,861 B1 * 9/2002 Nomura et al. ..... 123/90.23
6,505,592 B1 * 1/2003 Hayman et al. ..... 123/90.61
6,510,837 B1 * 1/2003 Aoyama ..... 123/308

FOREIGN PATENT DOCUMENTS

JP 1-132485 A 5/1989
JP 9-287464 A 11/1997
JP 2002-122007 A 4/2002

* cited by examiner

*Primary Examiner*—Marguerite McMahon
(74) *Attorney, Agent, or Firm*—Birch, Stewart, Kolasch & Birch, LLP

(57) ABSTRACT

A cylinder block, a cylinder head and a cylinder head cover are stacked in order to form a four-cycle engine. A valve train of a single overhead camshaft (SOHC) type provided with an intake valve and an exhaust valve is provided in the cylinder head. A line extending parallel with a joint between the cylinder head and the cylinder head cover is inclined forward and downward toward a line parallel with a joint between the cylinder block and the cylinder head. An axis of an exhaust valve and/or an axis of a plug tube is/are perpendicular to the line extending parallel with the joint between the cylinder head and the cylinder head cover. A cylinder head hanger is integrally formed at an uppermost end of a rear portion of the cylinder head over an intake port.

15 Claims, 6 Drawing Sheets

FOUR-CYCLE ENGINE

CROSS-REFERENCES TO RELATED APPLICATIONS

This nonprovisional application claims priority under 35 U.S.C. § 119(a) on Patent Application No. 2002-267178 filed in Japan on Sep. 12, 2002, the entirety of which is herein incorporated by reference.

BACKGROUND OF THE INVENTION

1. Field of the Invention

The present invention relates to a four-cycle engine used for a vehicle such as a motorcycle, and more particularly to a joint structure for a cylinder head and a cylinder head cover of a four-cycle engine for a vehicle.

2. Description of the Background Art

A conventional four-cycle engine of the background art includes a double overhead camshaft (DOHC) having an intake valve and an exhaust valve driven by different camshafts. Japanese published unexamined patent application No. Hei1-132485, e.g., pp. 9 and 10, and FIGS. 4 and 5 of this document; and Japanese published unexamined patent application No. Hei9-287464, e.g., 0021 (identifier), and FIG. 2 of this document, each describe the above-described four-cycle engine arrangement. Specifically, a joint of a cylinder head and a cylinder head cover (hereinafter referred to as a head cover joint) is inclined toward the joint of the cylinder head and a cylinder block (hereinafter called a cylinder joint). Accordingly, the cylinder head can be decreased in size.

Japanese published unexamined patent application No. 2002-122007, e.g., FIG. 1 of this document, describes an engine of a single overhead camshaft (SOHC) type having an intake valve driven by one camshaft and an exhaust valve driven by the same (common) camshaft via a valve arm. In this type of engine, an engine hanger is provided below an intake port of a cylinder head, and the engine hanger supports a body frame.

SUMMARY OF THE INVENTION

The present invention overcomes several shortcomings associated with the background art and achieves other advantages not realized by the background art. The present inventors have determined that since intake and exhaust valves are provided at a predetermined angle in the above-described cylinder head for a four-cycle engine, the holes for these valves are formed by machining provided with a plurality of different working shafts. Therefore, the machining and manufacture of these features is time consuming, cumbersome and limits the enhancement of the working precision of related parts.

Similarly, if the head cover joint is inclined and the working axes of the intake valve and the exhaust valve are not uniform, it is even more difficult to machine these pieces of the engine. Therefore, the present inventors have determined that it would be beneficial to reduce the complexity of the manufacturing steps required to construct an inclined head cover joint.

If an engine hanger, a head hanger of a cylinder head and a front hanger in the front of a crankcase are provided in an engine, and these hangers are arranged extending along a diagonal line when viewed from the side, it is desirable that the head hanger is provided in as high a position as possible with respect to the cylinder head to extend across a supporting span and stably support the engine. This location is similar to a position over the intake port at the upper end of the rear of the cylinder head, however, this location part has no spare space since the intake port is formed therein.

Therefore, in the case of the afore-mentioned SOHC type engine, it is also conceivable that an engine hanger is provided on the lower side of an intake port. However, if the engine requires more stable support, it is desirable that an engine hanger be provided in the above-mentioned position that has been thought the most desirable.

Accordingly, an object of the present invention is to overcome one or more of the aforementioned shortcomings of the background art.

Since the head cover joint is inclined toward the cylinder joint, the cylinder head can be reduced in size and the weight of the entire engine can be reduced. Since the axes of the intake and exhaust valves, the insertion hole of the ignition plug, or the joint axis of the part are perpendicular to the head cover joint, a machining axis for these parts having such an axis can be made perpendicular to the head cover joint, e.g., thereby improving machining precision and facilitating manufacture. If the head cover joint is inclined downward from the side of the intake port toward the side of the exhaust port, space can be secured over the intake port of the cylinder head. Then, as the engine hanger can be integrated in a position in the vicinity of the cylinder head cover joint utilizing the space, the engine support span is extended and stable support is enabled. In addition, a degree of the freedom of an engine hanger formed position can be enhanced. If the valve train is the SOHC type, a part without a camshaft of the cylinder head cover is lowered and the weight of the cylinder head cover can be reduced.

One or more of these and other objects are accomplished by a four-cycle engine comprising a cylinder block; a cylinder head; a cylinder head cover, wherein the cylinder head cover is stacked on top of the cylinder head and the cylinder head is stacked above the cylinder block; an intake valve and an exhaust valve opening or closing by an operative engagement with a camshaft arranged above the cylinder head; a joint being formed between the cylinder head and cylinder block, wherein the joint of the cylinder head and the cylinder block extends diagonally with respect to an axis of either the intake valve or the exhaust valve; and a joint being formed between the cylinder head and the cylinder head cover, wherein the axis of either the intake valve or the exhaust valve is perpendicular to the joint between the cylinder head and the cylinder head cover.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

DETAILED DESCRIPTION OF THE PREFERRED EMBODIMENTS

Figure 1:
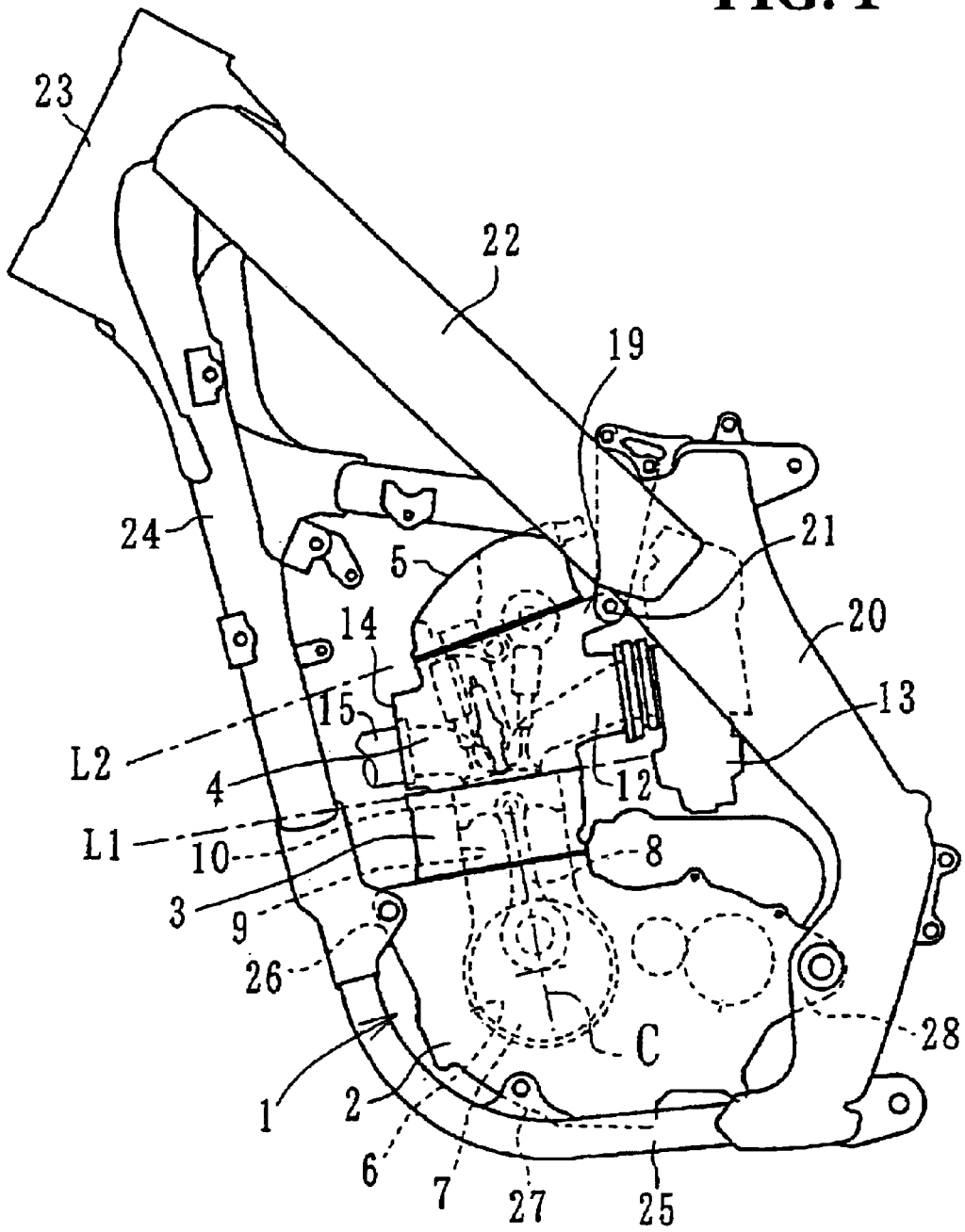
FIG. 1 is a side view of an engine mounted to a body frame according to an embodiment of the present invention.
Figure 2:
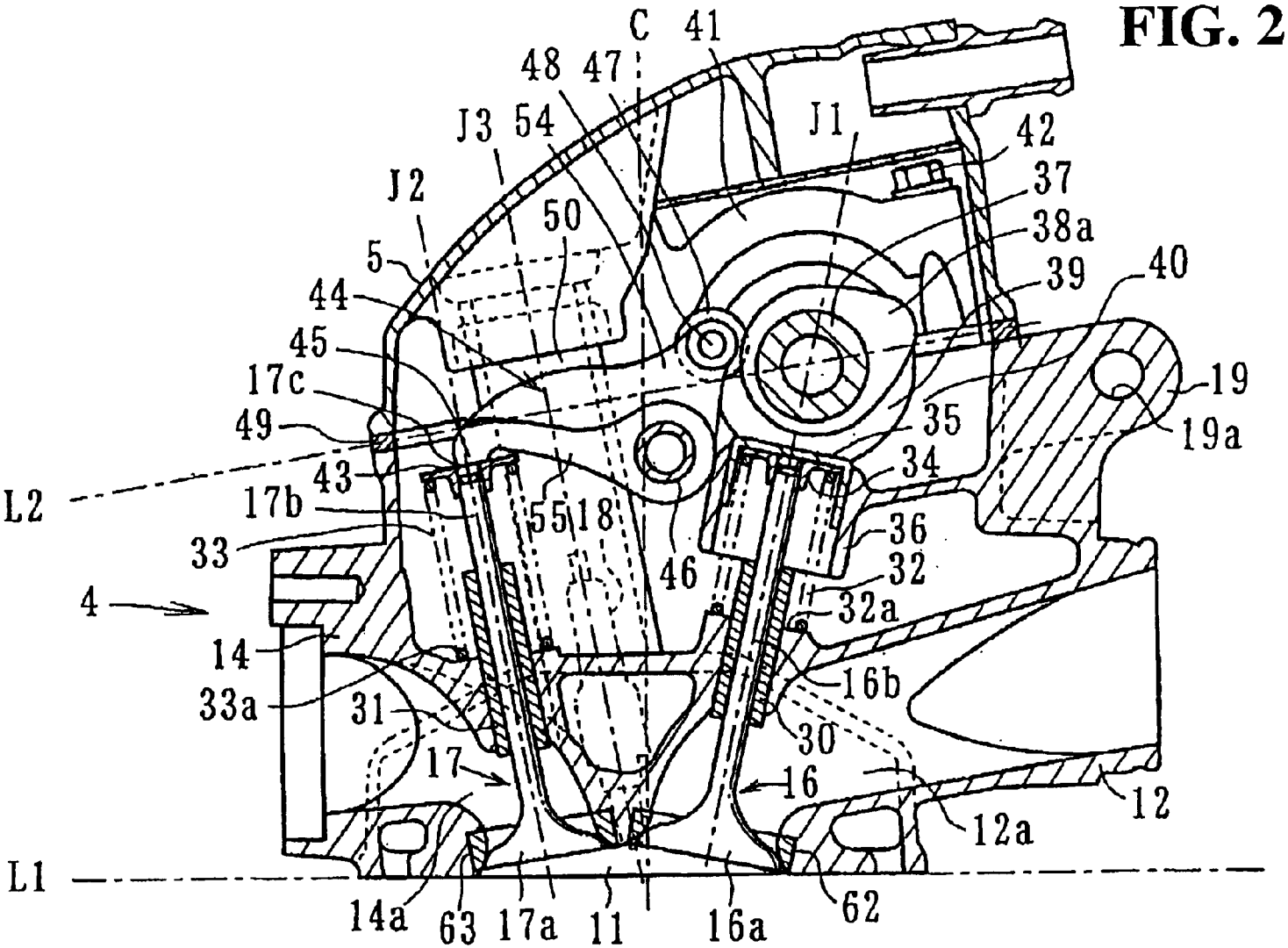
FIG. 2 is a side sectional view showing an upper part of the engine of FIG. 1.
Figure 3:
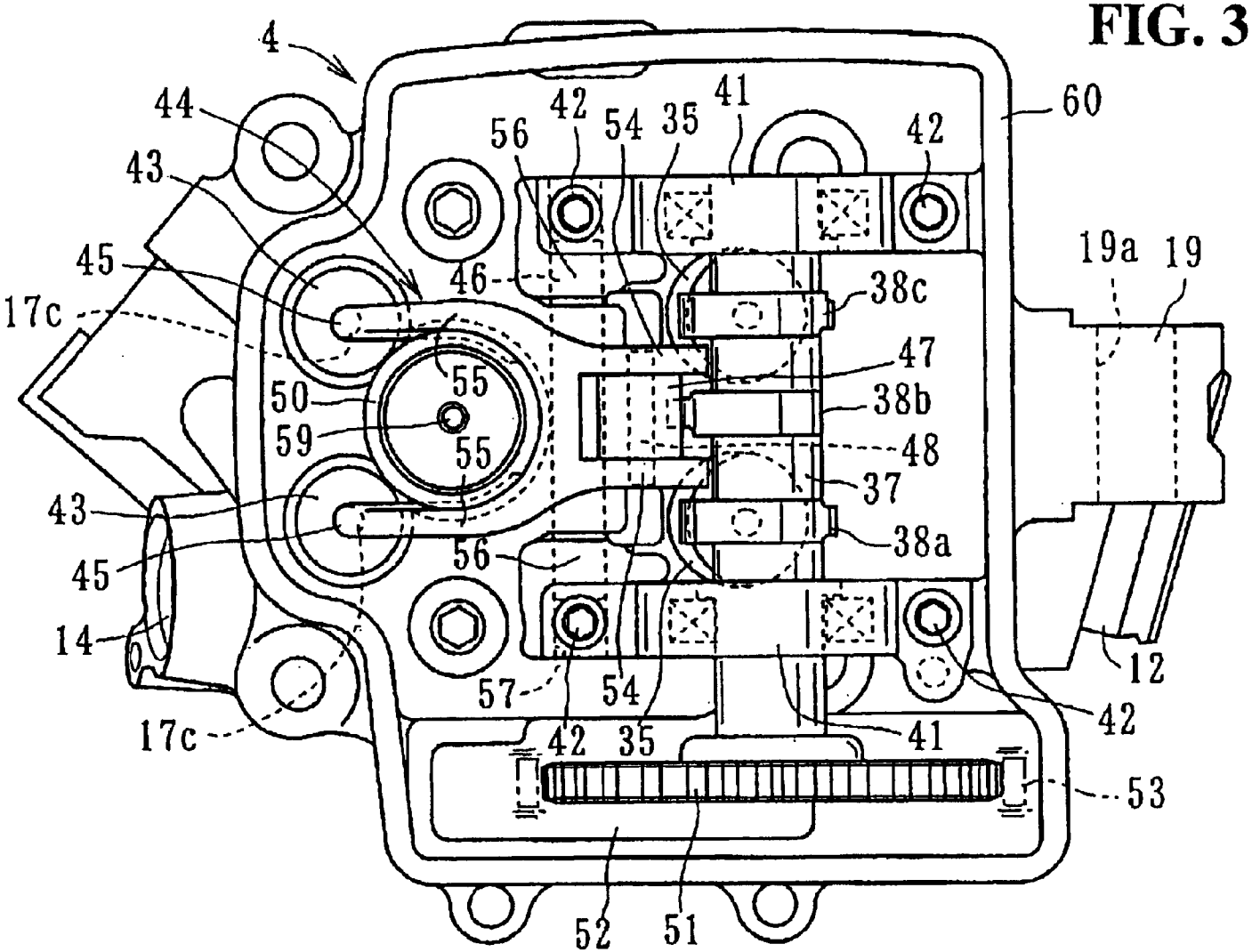
FIG. 3 is a cylinder head and a valve train viewed along a direction shown by an arrow Y in FIG. 4.
Figure 4:
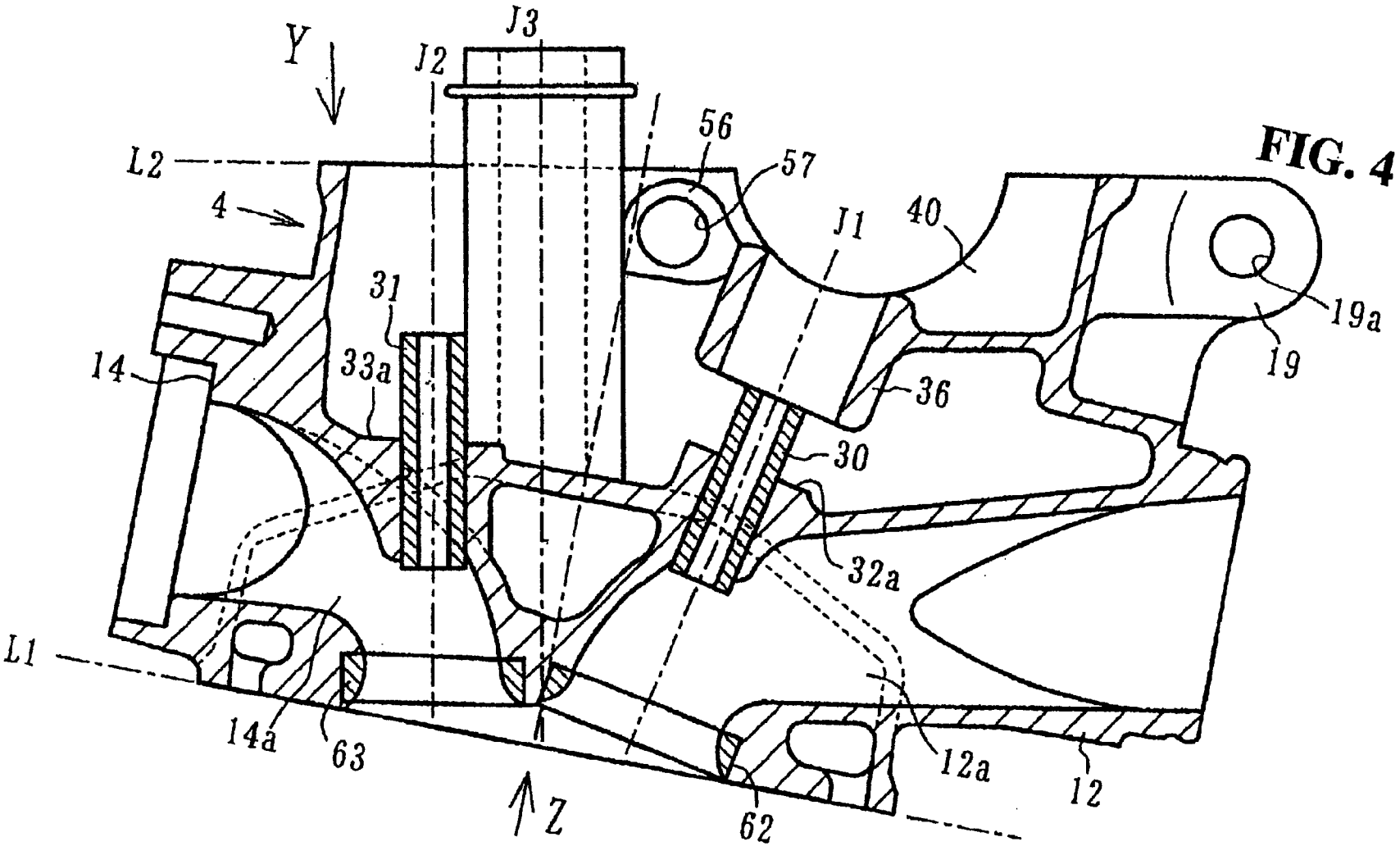
FIG. 4 is a side sectional view showing a cylinder head according to an embodiment of the present invention.
Figure 5:
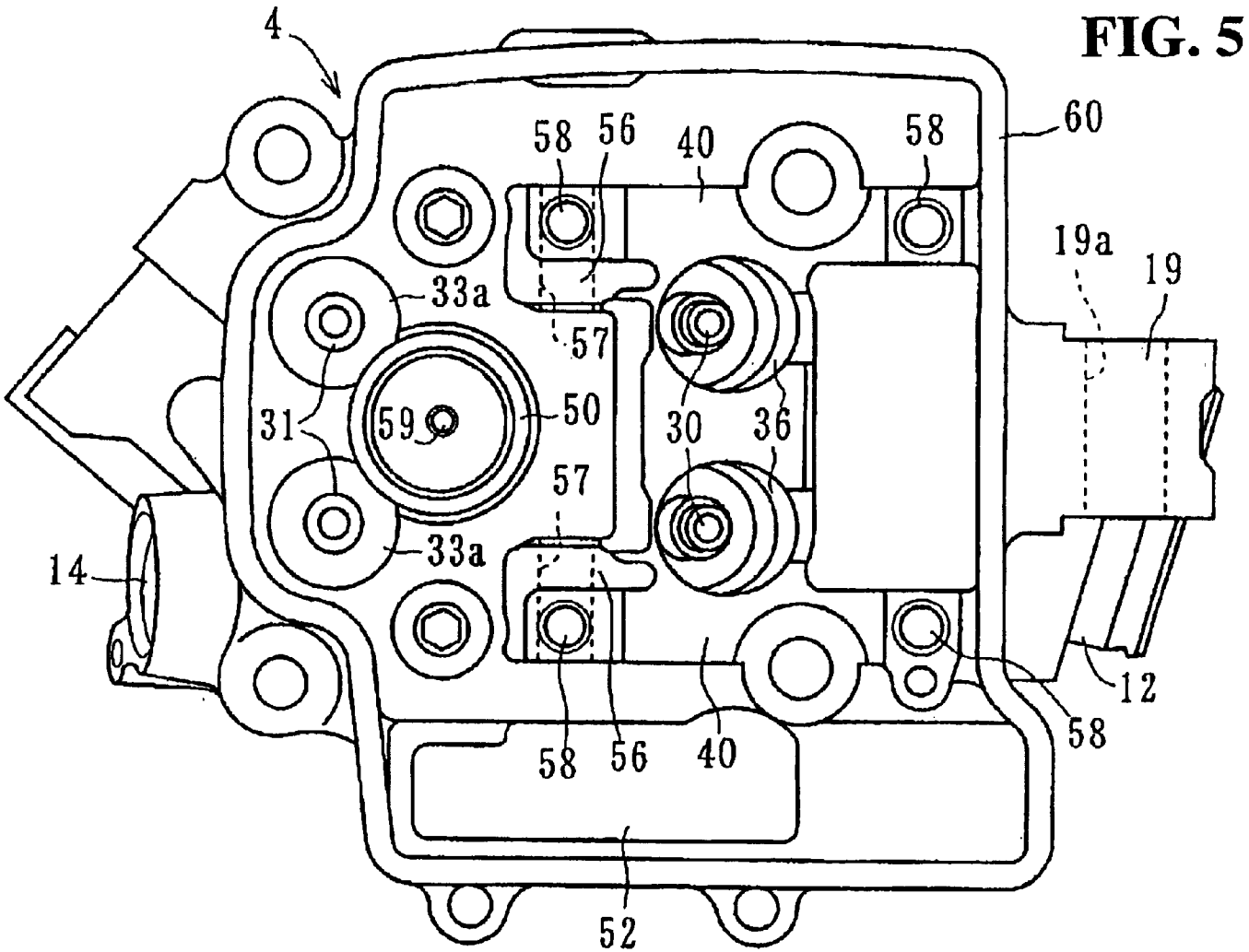
FIG. 5 is a plan view of an upper face of the cylinder head viewed along a direction shown by the arrow Y in FIG. 4.
Figure 6:
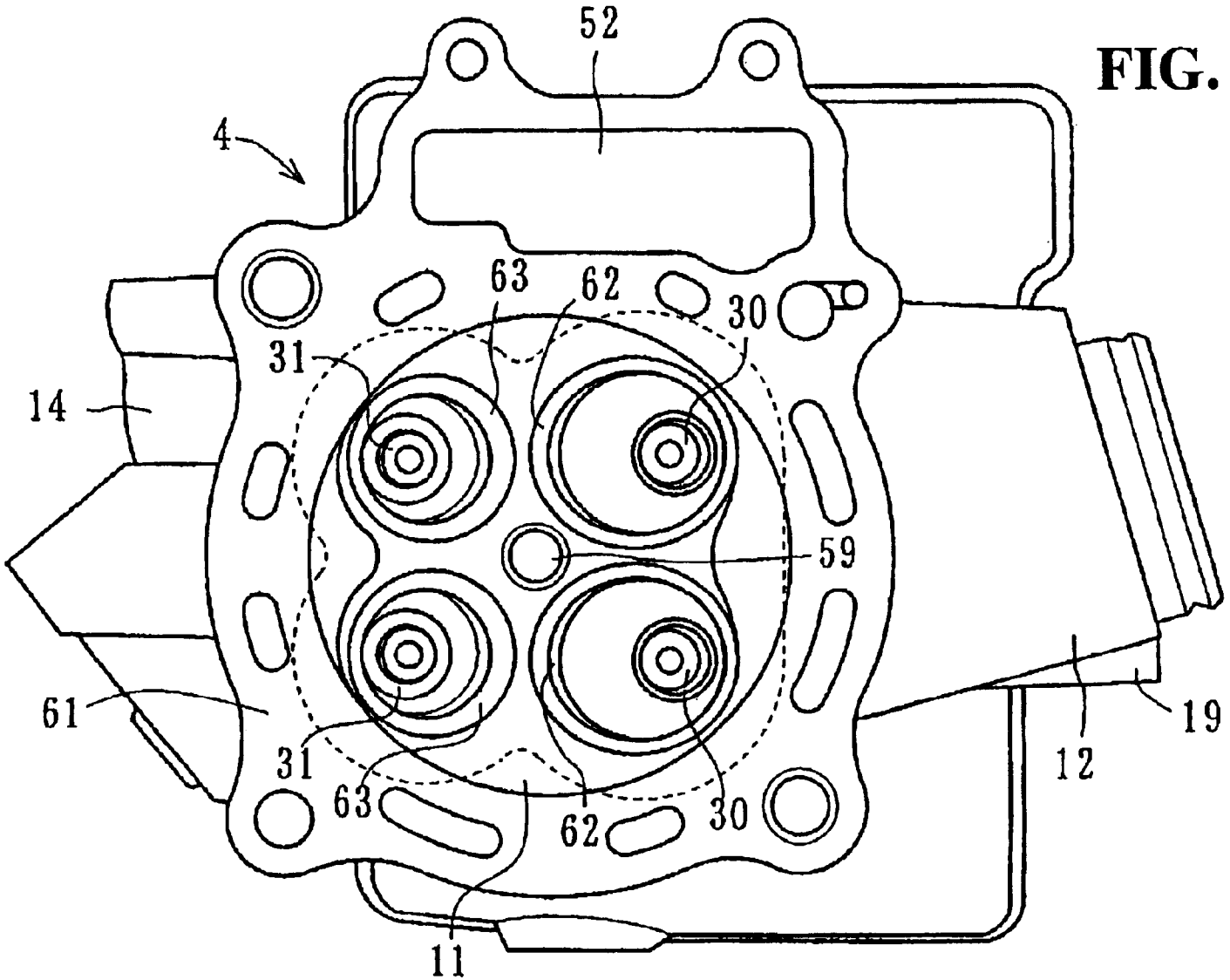
FIG. 6 is a side view of the cylinder head viewed along a direction shown by an arrow Z in FIG. 4.

The present invention will hereinafter be described with reference to the accompanying drawings. FIG. 1 is a side view of an engine mounted to a body frame according to an embodiment of the present invention. FIG. 2 is a side sectional view showing an upper part of the engine of FIG. 1. FIG. 3 is a cylinder head and a valve train viewed along a direction shown by an arrow Y in FIG. 4. FIG. 4 is a side sectional view showing a cylinder head according to an embodiment of the present invention. FIG. 5 is a plan view of an upper face of the cylinder head viewed along a direction shown by the arrow Y in FIG. 4. FIG. 6 is a side view of the cylinder head viewed along a direction shown by an arrow Z in FIG. 4.

Referring to the drawings, a preferred embodiment will be described in greater detail hereinafter. As shown in FIG. 1, the engine 1 is a water-cooled, single-cylinder four-cycle engine for a motorcycle. A crankcase 2, a cylinder block 3, a cylinder head 4 and a cylinder head cover 5 are stacked in this order and integrally form the engine 1. A crankshaft 7 is rotatably provided in a crank chamber 6 of the crankcase 2 and is coupled to a piston 10 slidably fittled in a cylinder 9 of the cylinder block 3 via a connecting rod 8.

An air-fuel mixture is supplied to the cylinder head 4 from a carburetor 13 via an intake port 12 opening rearward from the body and is exhausted from an exhaust port 14 via an exhaust pipe 15 opening forward from the body. An integral head hanger 19 protrudes rearward over the intake port 12 at the uppermost end on the rear side of the cylinder head 4. The head hanger 19 is bolted on a stay 21 of the rear portion 20 of a cradle body frame. The cradle body frame is formed by coupling an upper part 22, a head pipe 23, a down pipe 24 and a lower part 25 together to form a loop-shaped cradle body frame when viewed from the side. The engine 1 is supported within the loop-shaped cradle body frame.

The crankcase 2 is supported by the lower end of the down pipe 24 via a front hanger 26 on an upper side of the front end. Similarly, the crankcase is supported by the lower part 25 at the bottom of the crankcase 2 via a bottom hanger 27 and is supported by a lower part of the rear portion 20 via a rear hanger 28. The head hanger 19 and the front hanger 26 are positioned along a diagonal line extending between the two elements, e.g, connecting an uppermost end of the diagonal line on the rear side of the cylinder head 4 and a final limit, front end of the crankcase and are arranged so that a span on the diagonal line is maximized.

A lower surface of the cylinder head 4, on which the cylinder head 4 and the cylinder block 3 are joined, forms a cylinder joint (a line on the joint or parallel to the joint is shown as a cylinder joint line L1). An upper surface of the cylinder head 4 on which the cylinder head 4 and the cylinder head cover 5 are joined forms a head cover joint (a line on the joint or parallel to the joint is shown as a head cover joint line L2 in FIGS. 1, 2 and 4). When viewed from the side as shown in FIG. 1, the cylinder joint line L1 is perpendicular to a cylinder axis C passing through the center of the cylinder 9 and the head cover joint line L2 diagonally crosses the cylinder axis, e.g., the head cover joint line L2 is inclined forward at a diagonal, and the cylinder joint line L1 is perpendicular.

The crankcase 2, the cylinder block 3, the cylinder head 4 and the cylinder head cover 5 are cast using a light alloy. Of these, the parts except the cylinder head cover 5 All of these parts, except the cylinder head cover 5, are die-cast using an aluminum alloy because of the high rigidity required. Particularly, the cylinder head 4 is cast by gravity die casting (hereinafter called GDC) because high strength is required. Since strength and rigidity are not relatively required and weight reduction is preferred, the cylinder head cover 5 is cast using a magnesium alloy.

As shown in FIG. 2, the intake port 12 and the exhaust port 14 communicate with a combustion chamber 11 formed in the cylinder head 4 via an intake passage 12*a* and an exhaust passage 14*a*. The intake passage and the exhaust passage 14*a* are opened or closed by an intake valve 16 and an exhaust valve 17, respectively, such as poppet valves. Reference numbers 16*a* and 17*a* denote a valve seat 16*b* and 17*b* denotes a valve stem. The cross section of the exhaust passage 14*a* is smaller than that of the intake passage 12*a* and therefore, the area of the valve seat 17*a* in the exhaust valve 17 is also smaller than that of the valve seat 16*a* in the intake valve 16. A reference number 18 denotes an ignition plug. A valve train for driving the intake valve 16 and the exhaust valve 17 is integrally formed with a SOHC, and the valve train is housed in a cam mechanism formed between the cylinder head 4 and the cylinder head cover 5.

The intake valve 16 and the exhaust valve 17 are respectively guided in guide cylinders 30 and 31 into which respective valve stems 16*b* and 17*b* are press-fitted at a predetermined angle with respect to the cylinder head 4. Each axis of the intake valve 16 and the exhaust valve 17 (the axis of each stem 16*b*, 17*b* and the corresponding guide cylinders 30, 31) are shown as J1 and J2, respectively. The axis J2 of the exhaust valve 17 is perpendicular to the head cover joint line L2. The axis J1 of the intake valve 16 crosses the head cover joint line L2 and the cylinder joint line L1 at a diagonal. The intake valve 16 and the exhaust valve 17 are respectively pressed in a closed direction by springs 32 and 33. Reference numbers 32*a* and 33*a* denote a spring seat of each spring 32, 33.

The upper end of the spring 32 is received by a retainer 34 provided at the upper end of the intake valve 16 and a lifter 35 covers the retainer. The lifter 35 is inserted into a lifter holder 36 integrated with the cylinder head 4 and is lifted by a cam 38*a* on a camshaft 37. The camshaft 37 is supported by a bearing 39. The bearing 39 is supported by a camshaft holder 40 integrated with the cylinder head 4, is pressed by a cam cap 41 from the upside and is fixed by a bolt 42. The joint of the camshaft holder 40 and the cam cap 41 is parallel to the head cover joint line L2.

A retainer 43 is provided at the end of the exhaust valve 17. The retainer 43 receives the upper end of the spring 33. The exhaust valve 17 is lifted by pressing a stem end 17*c* of the exhaust valve 17 by the end 45 of a rocker arm 44. The intermediate part of the rocker arm 44 is supported by a rocker arm shaft 46 so that the intermediate part can be rocked in the cylinder head 4, a roller 47 is provided to the other end of the rocker arm 44 and a cam (described later) on the camshaft 37 is in slidable contact therewith. The roller 47 is supported by a shaft 48 so that the roller can be turned toward the other end of the rocker arm 44.

The rocker arm 44 is rocked using the rocker arm shaft 46 as a fulcrum by driving the roller 47 by the cam. Thereby, an SOHC mechanism in which the valve train can simultaneously drive the intake valve 16 and the exhaust valve 17 by only one camshaft 37 is formed. Cams 38*a* and 38*c* on the intake side and a cam 38*b* on the exhaust side have different phases so that respective lift timing is acquired.

A gasket 49 and a plug tube 50 are also shown in FIG. 2. The plug tube 50 is a cylinder opening upward and the ignition plug 18 is inserted and attached inside the plug tube 50. Its axis J3 is parallel to the axis J2 of the exhaust valve 17 and is perpendicular to the head cover joint line L2. A reference number 19*a* denotes a through hole provided in the head hanger 19 protruding rearward in the center in a direction of the body width of the combustion chamber 11 in the direction of the body width. The through hole is provided to accommodate a bolt when the head hanger is attached to the stay 21.

As shown in FIG. 3, the camshaft 37 is arranged in parallel with the crankshaft 7 shown in FIG. 1 in the direction of the body width and a cam sprocket 51 is integrated with one end. The cam sprocket 51 is opposite to a cam chain chamber 52 protruding on one side of the cylinder head 4 and a cam chain 53 is wound between the cam sprocket and a cam driving sprocket (not shown) provided onto the crankshaft 7. The cam sprocket 51 is turned via the cam chain 53 in synchronization with the crankshaft 7 and the camshaft 37 is rotated integrally with the cam sprocket 51.

A pair of the right and left intake valves 16 and a pair of right and left the exhaust valves 17 are provided and to drive them, three cams 38*a*, 38*b* and 38*c* are provided in the axial direction of the camshaft 37. The right and left cams 38*a* and 38*c* are in sliding contact to each upper portion of right and left lifters 35 and 35. The cam 38*b* in the center is in sliding contact with the roller 47 of the rocker arm 44. The roller 47 enters between the forked rear portions 54 and 54 of the rocker arm and is rotatably supported by the rear portions 54 and 54 of the rocker arm via a shaft 48.

The front 55 of the rocker arm is also forked, e.g., forked parts extend via the right and left outsides of the plug tube 50 and the ends 45 and 45 are located over the stem ends 17*c* and 17*c* of the right and left exhaust valves 17 and 17. Both ends of the rocker arm shaft 46 are supported by a rocker arm shaft holder 56 integrated with the cylinder head 4. The rocker arm shaft 46 is prevented from falling by the bolt 42 for fastening the cam cap 41 in the rocker arm shaft holder 56.

FIGS. 4 to 6 show the cylinder head 4. As shown in FIGS. 4 and 5, a hole 57 for the rocker arm shaft 46 is formed laterally in the rocker arm shaft holder 56*s*, e.g., lateral ends pierce the right and left rocker arm shaft holders 56 and 56 and cross female tapped holes 58 and 58 for inserting the bolt 42. The female tapped hole 58 is formed in the camshaft holder 40 and the rocker arm shaft 46 is prevented from falling by inserting the bolt 42. An electrode hole 59 integral with the cylinder head 4 is formed at the bottom of the plug tube 50 protruding diagonally upward and opposite to the combustion chamber 11. When the ignition plug 18 is inserted into the bottom of the plug tube 50 and is fastened, an electrode at the end enters the combustion chamber 11. A head cover joint 60, the cylinder joint 61, and valve seats 62, 63 are also shown.

As shown in these drawings, the axis J2 of the guide cylinder 31 on the side of the exhaust valve 17 and the axis J3 of the plug tube 50 are parallel and are respectively perpendicular to the head cover joint line L2. The axis of the electrode hole 59 formed in the plug tube 50 is also coincident with J3. The female tapped hole 58 for the bolt 42 for fastening the cam cap 41 is also parallel with these axes. Therefore, these holes are made by machining with the same working shaft/tool. Further, the axis of the valve seat 63 on the exhaust side is also coincident with J2 and the valve seat 63 can be also attached by machining using the same working shaft/tool.

As the head cover joint line L2 is inclined forward and downward toward the cylinder joint line L1 when the head cover joint line L2 is viewed from the side, the vertical width/height on the side of the intake port 12 is widened and the head hanger 19 is integrally formed at the upper end of the back of the cylinder head 4 over the intake port 12. The cross section of the passage on the side of the exhaust port 14 is relatively small compared with that on the side of the intake port 12.

Next, the operation of this preferred embodiment will be described in greater detail hereinafter. As shown in FIGS. 2 and 4, the top face of the cylinder head 4 is inclined toward the bottom. That is, the head cover joint line L2 is inclined diagonally downward toward the front of the body toward the cylinder joint line L1, and each axis J2 of the exhaust valve 17 and the valve seat 63, the axis J3 of the plug tube 50 and further, the axis of the female tapped hole 59 shown in FIG. 5 for fastening the cam cap 41 with the bolt 42 are perpendicular to the head cover joint line L2.

Therefore, since the working shaft for the exhaust valve 17, the valve seat 63, the plug tube 50 and the female tapped hole 58 are coincident when these holes are machined after the cylinder head 4 is cast, these components can be worked or machined with the same equipment and/or along the same axis. Therefore, the production of these components is facilitated, precision in manufacture is enhanced, and the costs can be also reduced.

In addition, the height on the side of the exhaust passage 14*a*, the cross section of which is small, of the side wall of the cylinder head 4 is reduced by inclining the head cover joint line L2 downward toward the exhaust port 14 side to incline the joint of the cylinder head 4 and the cylinder head cover 5. By adopting the SOHC type, the weight of the cylinder head cover 5 can be reduced by inclining the upper portion of the cylinder head cover 5 on the side of the rocker arm 44 diagonally downward. In addition, the weight ratio of the cylinder head 4 to the cylinder head cover 5 is reduced by the quantity in which the head cover joint line L2 is inclined. Conversely, the weight ratio of the cylinder head cover 5 is increased and the weight of the whole engine can be reduced by forming the cylinder head 4 by GDC and using a lighter magnesium alloy for the material of the cylinder head cover 5.

Further, as the side of the intake port 12 of the side wall of the cylinder head 4 is higher, a large space can be secured over the intake port 12. In contrast to an arrangement in which the cross section of the passage was large and there was no spare space, the head hanger 19 can now be integrally formed utilizing this space and a degree of freedom of a head hanger formed position can be enhanced.

In addition, the head hanger 19 is attached to the uppermost end on the rear side of the cylinder head 4. Since the crankcase 2 is supported by the lower end of the down pipe 24 via the front hanger 26 in an upper part at the front end, the head hanger 19 and the front hanger 26 are positioned so that a diagonal line connecting the uppermost end on the rear side of the cylinder head 4 and the final limit front end of the crankcase 2 when they are viewed from the side in which a span of the diagonal line is maximized. Therefore, the support of the engine 1 can be stabilized at the maximum.

Since the cam holder 40, a lifter hole 36 and the rocker arm shaft holder 56 are integrated with the cylinder head 4, rigidity can be enhanced. Further, as these can be formed by GDC, the strength of the material is enhanced and the resistance to the increase of the engine speed can be enhanced. In addition, the number and weight of parts can be reduced by adopting the SOHC type for the valve train.

The invention is not limited to the above-mentioned embodiments and within the principle of the invention, various transformation and application are possible. For example, if the principal object is to unify the working shaft, the head cover joint may be also inclined to the side of the intake port. Although the invention has been described with respect to a single-cylinder engine, the present invention can also be applied to a multi-cylinder engine.

Although the joint axis of the bolt 42 for fastening the cam cap 41 is parallel with J2, this joint may be also a fastening member for fixing not only the cam cap 41 but another suitable part. Besides, the invention is not limited to the SOHC type and can be also applied to a valve train of a DOHC type.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A four-cycle engine comprising:

a cylinder block;

a cylinder head;

a cylinder head cover, wherein said cylinder head cover is stacked on top of said cylinder head and said cylinder head is stacked above said cylinder block;

an intake valve and an exhaust valve opening or closing by an operative engagement with a camshaft arranged above the cylinder head;

a joint being formed between the cylinder head and cylinder block, wherein the joint of the cylinder head and the cylinder block extends diagonally with respect to an axis of either the intake valve or the exhaust valve;

a joint being formed between the cylinder head and the cylinder head cover, wherein the axis of either the intake valve or the exhaust valve is perpendicular to the joint between the cylinder head and the cylinder head cover; and an insertion hole having an ignition plug formed therein, wherein an axis of the insertion hole of the ignition plug is formed perpendicular to the joint of the cylinder head and the cylinder head cover.

2. The four-cycle engine according to claim 1, further comprising:

a rocker arm having a pair of forked ends extending around a plug tube of said ignition plug and;

a rocker arm shaft being supported by a rocker arm shaft holder integrally connected with the cylinder head.

3. The four-cycle engine according to claim 2, further comprising a cam cap securing the rocker arm shaft, wherein the rocker arm shaft is secured by a bolt fastening the cam cap in the rocker arm shaft holder.

4. The four-cycle engine according to claim 3, further comprising a female tapped hole for securing the bolt within the rocker arm shaft holder, wherein an axis of the female tapped hole is perpendicular to the joint between the cylinder head and the cylinder head cover.

5. The four-cycle engine according to claim 4, further comprising an insertion hole having an ignition plug formed therein, wherein an axis of the insertion hole of the ignition plug is formed perpendicular to the joint of the cylinder head and the cylinder head cover.

6. A four-cycle engine comprising:

a cylinder block;

a cylinder head;

a cylinder head cover, wherein said cylinder head cover is stacked on top of said cylinder head and said cylinder head is stacked above said cylinder block;

an intake valve and an exhaust valve opening or closing by an operative engagement with a camshaft arranged above the cylinder head;

a joint being formed between the cylinder head and cylinder block, wherein the joint of the cylinder head and the cylinder block extends diagonally with respect to an axis of either the intake valve or the exhaust valve;

a joint being formed between the cylinder head and the cylinder head cover, wherein the axis of either the intake valve or the exhaust valve is perpendicular to the joint between the cylinder head and the cylinder head cover; and an intake port and an exhaust port, wherein the joint of the cylinder head and the cylinder head cover is inclined downward from an intake port side of the cylinder head toward an exhaust port side of the cylinder head.

7. The four-cycle engine according to claim 6, further comprising an engine hanger being integrally formed with the cylinder head in a position above the intake port of the cylinder head and in a vicinity of the joint between the cylinder head and the cylinder head cover.

8. The four-cycle engine according to claim 5, further comprising an intake port and an exhaust port, wherein the joint of the cylinder head and the cylinder head cover is inclined downward from an intake port side of the cylinder head toward an exhaust port side of the cylinder head.

9. The four-cycle engine according to claim 8, further comprising an engine hanger being integrally formed with the cylinder head in a position above the intake port of the cylinder head and in a vicinity of the joint between the cylinder head and the cylinder head cover.

10. The four-cycle engine according to claim 1, further comprising a valve train, wherein said valve train is a Single Overhead Camshaft (SOHC) valve train having a single overhead camshaft.

11. The four-cycle engine according to claim 7, further comprising a valve train, wherein said valve train is a Single Overhead Camshaft (SOHC) valve train having a single overhead camshaft.

12. The four-cycle engine according to claim 9, further comprising a valve train, wherein said valve train is a Single Overhead Camshaft (SOHC) valve train having a single overhead camshaft.

13. The four-cycle engine according to claim 1, further comprising a valve train, wherein said valve train is a dual overhead camshaft (DOHC) valve train having dual overhead camshafts.

14. The four-cycle engine according to claim 7, further comprising a valve train, wherein said valve train is a dual overhead camshaft (DOHC) valve train having dual overhead camshafts.

15. The four-cycle engine according to claim 9, further comprising a valve train, wherein said valve train is a Single Overhead Camshaft (SOHC) valve train having a single overhead camshaft.

* * * * *